US012680329B2

(12) United States Patent
Gates

(10) Patent No.: US 12,680,329 B2
(45) Date of Patent: Jul. 14, 2026

(54) SECURITY VAULT

(71) Applicant: Brian K. Gates, Vian, OK (US)

(72) Inventor: Brian K. Gates, Vian, OK (US)

( * ) Notice: Subject to any disclaimer, the term of this patent is extended or adjusted under 35 U.S.C. 154(b) by 54 days.

(21) Appl. No.: 18/482,362

(22) Filed: Oct. 6, 2023

(65) Prior Publication Data

US 2024/0117651 A1 Apr. 11, 2024

Related U.S. Application Data

(60) Provisional application No. 63/379,017, filed on Oct. 11, 2022.

(51) Int. Cl.

| | |
|---|---|
| ***E04H 9/14*** | (2006.01) |
| ***E04H 9/12*** | (2006.01) |
| ***F24F 7/00*** | (2021.01) |
| ***F24F 13/20*** | (2006.01) |

(52) U.S. Cl.

CPC ..... *E04H 9/14* (2013.01); *F24F 7/00* (2013.01); *F24F 13/20* (2013.01); *F24F 2007/0025* (2021.01)

(58) Field of Classification Search

CPC ..... E04H 1/1205; E04H 1/1277; E04H 2001/1288; E04H 2001/1294; E04H 3/08; E04H 9/02; E04H 9/028; E04H 9/029; E04H 9/04; E04H 9/06; E04H 9/10; E04H 9/14; F24F 7/00; F24F 13/20; F24F 2007/0025

See application file for complete search history.

(56) References Cited

U.S. PATENT DOCUMENTS 4,174,861 A * 11/1979 Drake ..... E05C 17/166 70/93
4,482,177 A * 11/1984 Nagy ..... E05C 17/365 292/264
4,559,881 A * 12/1985 Lankard ..... E04C 2/06 106/644
4,748,790 A * 6/1988 Frangolacci ..... H05K 9/0001 428/116
4,843,788 A * 7/1989 Gavin ..... E04H 3/08 52/750
5,036,634 A * 8/1991 Lessard ..... E04H 1/1205 D25/16
6,334,278 B1 * 1/2002 Arnold ..... E04H 9/06 52/79.5

(Continued)

FOREIGN PATENT DOCUMENTS

GB 2521763 A * 7/2015 ..... E04H 1/1205

*Primary Examiner* — Kyle J. Walraed-Sullivan
(74) *Attorney, Agent, or Firm* — Dunlap Codding, P.C.

(57) ABSTRACT

A security vault has a housing, a door assembly, and an exterior vent cover. The housing has a plurality of walls, a plurality of corners interconnecting the plurality of walls, and a roof connected to the plurality of walls and the plurality of corners. Each of the corners has a vent opening. The door assembly is secured to at least one of the plurality of walls to permit ingress to and egress from the shelter cavity of the housing. The exterior vent cover is formed by a corner shaped member detachably secured to the walls so as to be interchangeable with a different vent cover. The exterior vent cover conforms to the contour of the corner and cooperates with the vent opening to allow for ventilation to the shelter cavity.

16 Claims, 15 Drawing Sheets

(56) References Cited

U.S. PATENT DOCUMENTS 6,341,451 B1 * 1/2002 Morton, Sr. ..... E04H 6/04 52/64
6,412,231 B1 * 7/2002 Palatin ..... E04H 9/10 52/79.14
6,415,557 B1 * 7/2002 McCalley ..... E04H 9/14 52/584.1
6,415,558 B1 * 7/2002 Cherry ..... E04H 9/14 52/270
6,701,678 B1 * 3/2004 Skov ..... E04H 1/1205 52/79.9
6,886,895 B2 * 5/2005 Previte ..... G06F 1/16 312/213
7,458,305 B1 * 12/2008 Horlander ..... F41H 5/24 52/800.1
7,690,159 B1 * 4/2010 Arnold ..... A01K 1/033 52/79.5
8,776,453 B1 * 7/2014 Fain ..... E04C 2/08 52/79.12
9,394,714 B1 * 7/2016 Willsey ..... E04H 1/005
10,202,779 B1 * 2/2019 Willsey ..... E04C 2/523
2002/0046422 A1 * 4/2002 Perett ..... E04H 1/125 4/524
2004/0177568 A1 * 9/2004 Hanks ..... E04H 9/14 52/79.1
2005/0102917 A1 * 5/2005 Kofler ..... B62J 19/00 52/79.1
2006/0043739 A1 * 3/2006 Gogel ..... E05C 1/04 292/148
2006/0048458 A1 * 3/2006 Donald ..... E04H 9/14 52/69
2006/0080897 A1 * 4/2006 O'Neal ..... E04H 9/06 52/1
2006/0185260 A1 * 8/2006 Dehart ..... E04H 9/10 52/36.1
2007/0151186 A1 * 7/2007 Hanks ..... E04H 9/14 52/408
2007/0245638 A1 * 10/2007 Lai ..... E04H 1/125 52/79.1
2008/0148672 A1 * 6/2008 Monteer ..... E04F 13/007 52/716.2
2009/0313925 A1 * 12/2009 Lyons ..... E04B 1/34315 52/274
2010/0058693 A1 * 3/2010 Plumley ..... E04H 9/14 52/384
2010/0088987 A1 * 4/2010 Monteer ..... E04F 13/0841 52/302.6
2010/0115858 A1 * 5/2010 Olsen ..... E04H 9/14 49/476.1
2010/0293868 A1 * 11/2010 Holzworth ..... F41J 11/00 52/79.5
2012/0110926 A1 * 5/2012 Phillips ..... E04H 1/1205 52/79.9
2016/0130830 A1 * 5/2016 Magiera ..... E04H 9/06 109/1 S
2017/0081870 A1 * 3/2017 Hensen ..... E04B 1/34384
2017/0328080 A1 * 11/2017 Larimore ..... E05B 17/2038
2017/0350432 A1 * 12/2017 Hudson ..... E04C 2/205
2020/0149273 A1 * 5/2020 Arguin ..... A47B 5/00
2024/0125111 A1 * 4/2024 Leong ..... E04H 1/1205

* cited by examiner

SECURITY VAULT

CROSS-REFERENCE TO RELATED APPLICATIONS

This application claims the benefit of U.S. Provisional Application No. 63/379,017 filed Oct. 11, 2022, which is hereby incorporated herein by reference in its entirety.

BACKGROUND

It is sometimes desirable to provide a walk-in, high-strength, lockable vault inside a structure, like a house or business, to protect property from damage or theft or to serve as a shelter from intruders or natural disasters. Because of their size, such walk-in vaults are often located in an open space like a garage. As such, the vaults are generally visible to the occupants of the structure.

Walk-in vaults are generally constructed of heavy metal plates or panels, which often require the vaults to be built in place, making them expensive for the average person and prolonging construction time. A problem with many prefabricated vaults or safe rooms is the difficulty in moving them due to their size and weight. Many use pallet jacks, rollers, or pry bars to move them. This is not only inefficient and dangerous; it can damage the vault. Using metal plates or panels can also make the vaults unflattering in appearance.

Because one purpose of the vaults is security, the vaults are usually provided with a door latch. The door latches can be difficult for a young child to unlatch should the child wander into the vault and close the door. This results in the child being locked in the vault and requiring the vault to be cut open to get the child out.

To this end, a need exists for a vault that is easy to transport, easy to customize its appearance, and easy to access if accidentally locked. The inventive concepts disclosed and claimed herein are directed to such an apparatus.

BRIEF DESCRIPTION OF THE DRAWINGS

To assist those of ordinary skill in the relevant art in making and using the inventive concepts disclosed herein, reference is made to the appended drawings and schematics, which are not intended to be drawn to scale and in which, like reference numerals are intended to refer to the same or similar elements for consistency. For purposes of clarity, not every component may be labeled in every drawing. Certain features and views of the figures may be shown exaggerated and not to scale or schematic in the interest of clarity and conciseness. In the drawings.

DETAILED DESCRIPTION OF EXEMPLARY EMBODIMENTS

Figure 1A:
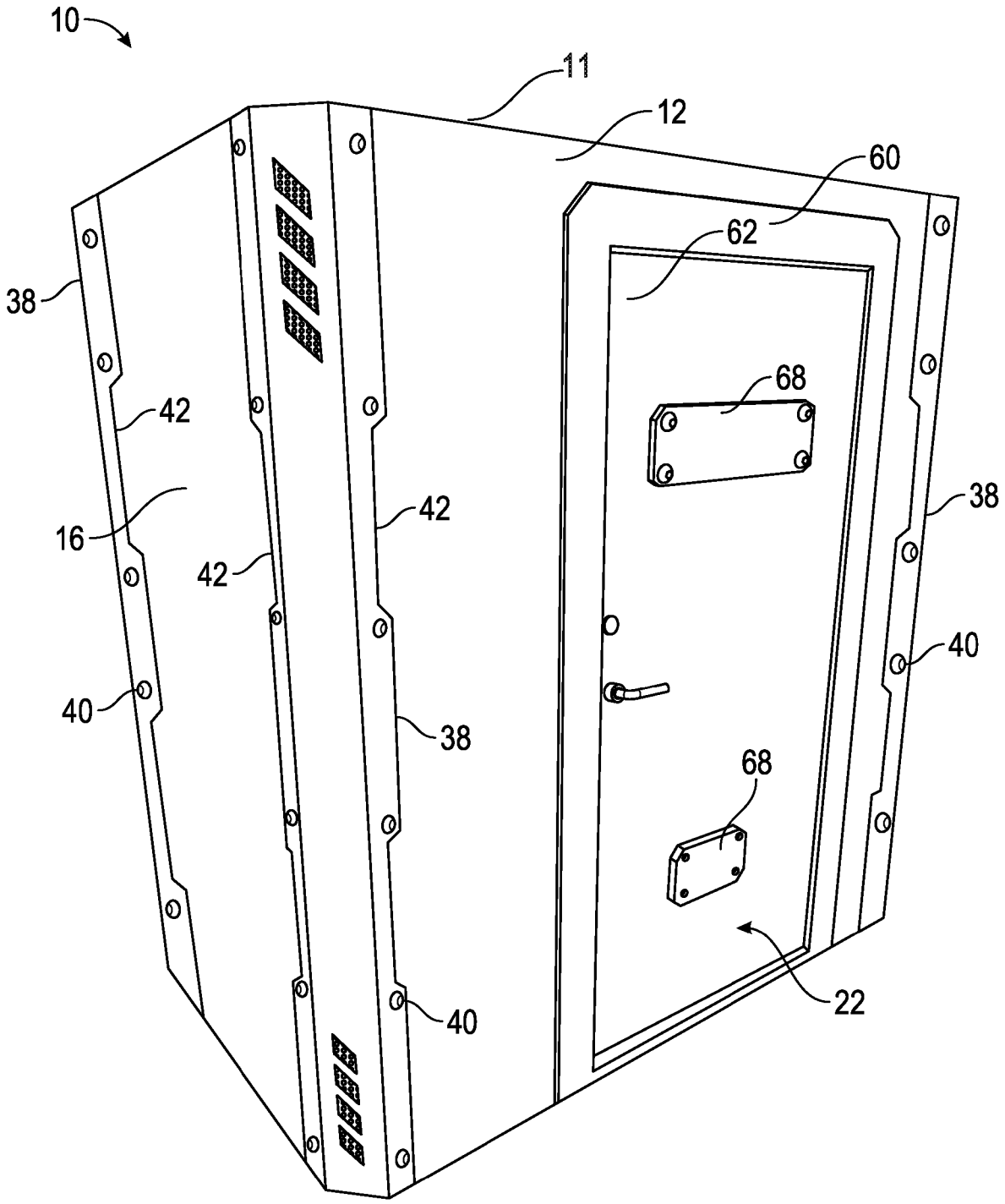
FIG. 1A is a perspective view of an exemplary embodiment of a security vault construction in accordance with the inventive concepts disclosed herein.

Before explaining at least one embodiment of the inventive concept(s) in detail by way of exemplary drawings, experimentation, results, and laboratory procedures, it is to be understood that the inventive concept(s) is not limited in its application to the details of construction and the arrangement of the components set forth in the following description or illustrated in the drawings, experimentation and/or results. The inventive concept(s) is capable of other embodiments or being practiced or carried out in various ways. The language used herein is intended to be given the broadest possible scope and meaning; the embodiments are meant to be exemplary—not exhaustive. Also, it is to be understood that the phraseology and terminology employed herein are for the purpose of description and should not be regarded as limiting.

Unless otherwise defined, scientific and technical terms used in connection with the presently disclosed and claimed inventive concept(s) shall have the meanings commonly understood by those of ordinary skill in the art. Further, unless otherwise required by context, singular terms shall include pluralities, and plural terms shall include the singular.

Given the present disclosure, all the articles, compositions, and/or methods disclosed and claimed herein can be made and executed without undue experimentation. While the articles, compositions, and methods of the inventive concept(s) have been described in terms of preferred embodiments, it will be apparent to those of skill in the art that variations may be applied to the articles, compositions and/or methods and in the steps or in the sequence of steps of the methods described herein without departing from the concept, spirit and scope of the inventive concept(s). All similar substitutes and modifications apparent to those skilled in the art are deemed to be within the spirit, scope, and concept of the inventive concept(s) as defined by the appended claims.

As utilized under the present disclosure, the following terms, unless otherwise indicated, shall be understood to have the following meanings:

The use of the word "a" or "an" when used in conjunction with the term "comprising" in the claims and/or the specification may mean "one," but it is also consistent with the meaning of "one or more," "at least one," and "one or more than one."

The use of the term "or" in the claims is used to mean "and/or" unless explicitly indicated to refer to alternatives only or the alternatives are mutually exclusive, although the disclosure supports a definition that refers to only alternatives and "and/or."

Throughout this application, the term "about" indicates that a value includes the inherent variation of error for the device, the method employed to determine the value or the variation among the study subjects.

The use of the term "at least one" will be understood to include one as well as any quantity more than one, including but not limited to, 2, 3, 4, 5, 10, 15, 20, 30, 40, 50, 100, etc. The term "at least one" may extend up to 100 or 1000 or more, depending on the term to which it is attached; in addition, the quantities of 100/1000 are not to be considered limiting, as higher limits may also produce satisfactory results. In addition, the use of the term "at least one of X, Y, and Z" will be understood to include X alone, Y alone, and Z alone, as well as any combination of X, Y, and Z.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if the order is important in a particular context, also BA, CA, CB, CBA, BCA, ACB, BAC, or CAB. Continuing with this example, expressly included are combinations that contain repeats of one or more item or term, such as BB, AAA, MB, BBC, AAABCCCC, CBBAAA, CABABB, and so forth. The skilled artisan will understand that, typically, there is no limit on the number of items or terms in any combination unless otherwise apparent from the context.

In the following detailed description of embodiments of the inventive concept, numerous specific details are set forth in order to provide a more thorough understanding of the inventive concept. However, it will be apparent to one of ordinary skill in the art that the inventive concept within the disclosure may be practiced without these specific details. In other instances, well-known features have not been described in detail to avoid unnecessarily complicating the instant disclosure.

Finally, as used herein, any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 1B:
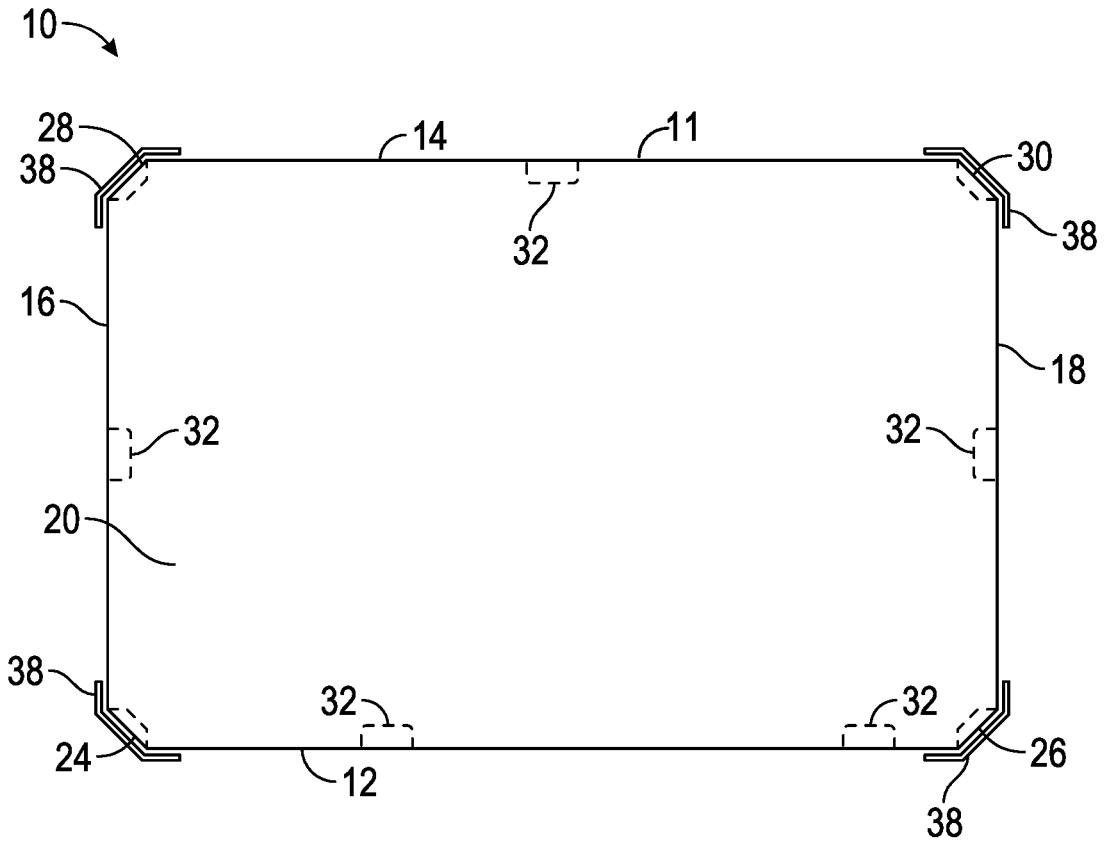
FIG. 1B is a top plan view of the security vault of FIG. 1A.
Figure 11A:
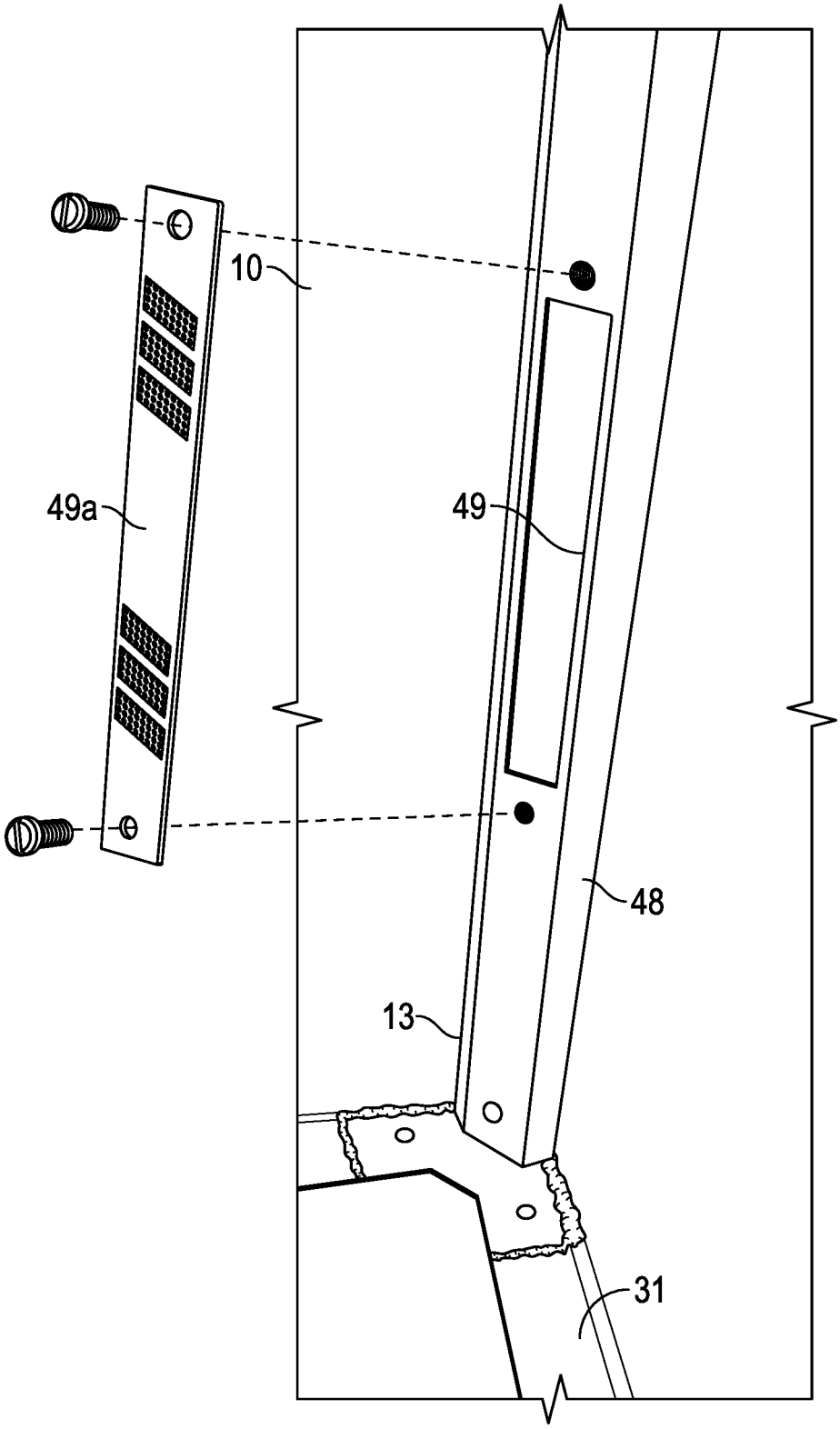
FIG. 11A is a partially exploded perspective view of a portion of an exemplary embodiment of an interior vent cover.
Figure 13:
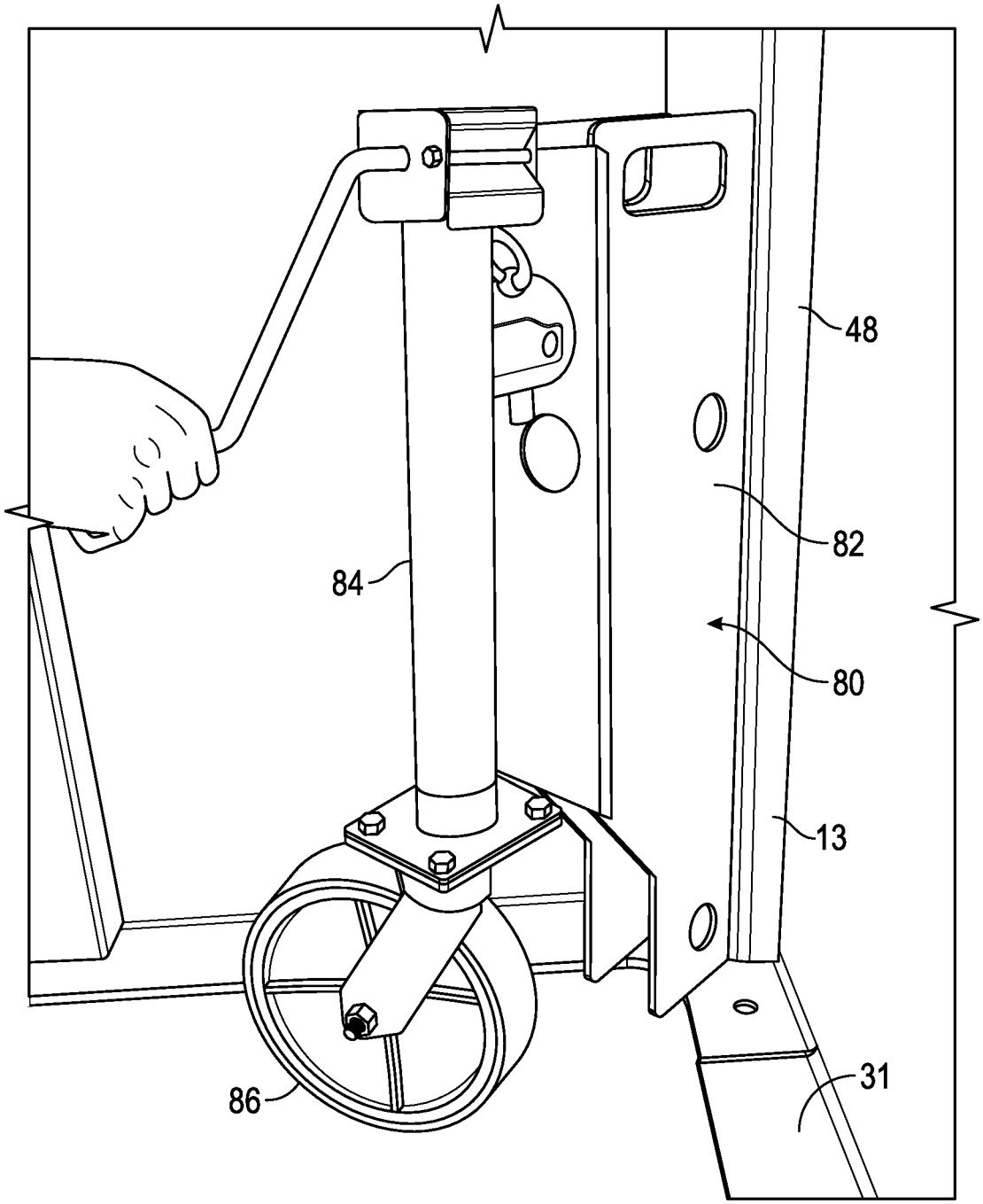
FIG. 13 is a perspective view showing the jack assembly connected to the vent plate of FIG. 11B.

Referring now to the drawings, and more particularly to FIGS. 1A and 1B, an exemplary embodiment of a security vault 10 constructed in accordance with the inventive concepts disclosed herein, is shown. The security vault 10 broadly has a housing 11 defining a shelter cavity 13 (FIGS. 11A and 13). The housing 11 includes a plurality of walls, a plurality of corners interconnecting the plurality of walls, and a roof connected to the plurality of walls and the plurality of corners. In one exemplary embodiment, the housing 11 has a front wall 12, a rear wall 14, a first sidewall 16, a second sidewall 18 (collectively "walls"), and a roof 20. In one embodiment, the front wall 12 and the first sidewall 16 are interconnected with a first corner 24; the front wall 12 and the second sidewall 18 are interconnected with a second corner 26; the rear wall 14 and the first sidewall 16 are interconnected with a third corner 28; and the rear wall 14 and the second sidewall 18 are interconnected with a fourth corner 30. In one exemplary embodiment, the corners 24, 26, 28, and 30 are beveled shaped as illustrated. However, it will be appreciated that the corners may be formed in various shapes, such as straight and rounded.

In one exemplary embodiment, the walls may be constructed of ¼ inch steel sheets or plates, although other thicknesses could be used. Generally, the walls may be formed by first bending a 3½ inch lip (FIGS. 11-13) in the sheet along the bottom to serve as a mounting flange 31. Next, the corners may be formed by bending the metal sheet to form a substantially L-shaped member. The L-shaped members are joined with the seams meeting in substantially the middle of each wall. However, it will be appreciated by those of ordinary skill in the art that the number of plates and where the seams fall may vary depending on the size of the security vault, but as an example, a security vault of four feet by six feet may consist of four L-shaped corners joined in the middle of each wall. In the middle of each wall (right, left, front, and rear) and on both sides of the door opening, vertical braces 32 (FIG. 1B) may be secured to the interior of the walls to provide vertical support and hide the inside welds of the seams.

The roof of the security vault 10 may be a ¼ inch steel plate secured to the upper end of the walls and supported with a middle horizontal support member (not shown) extending from the front wall 14 to the rear wall 16. The horizontal support may rest on top of the vertical channels 32. The seams between the walls and the seams between the roof 20 and the upper end of the walls may be joined by continuous welds. The vertical supports 32 and the horizontal support may be secured to the walls and the roof 20 with intermittent welds.

Figure 4:
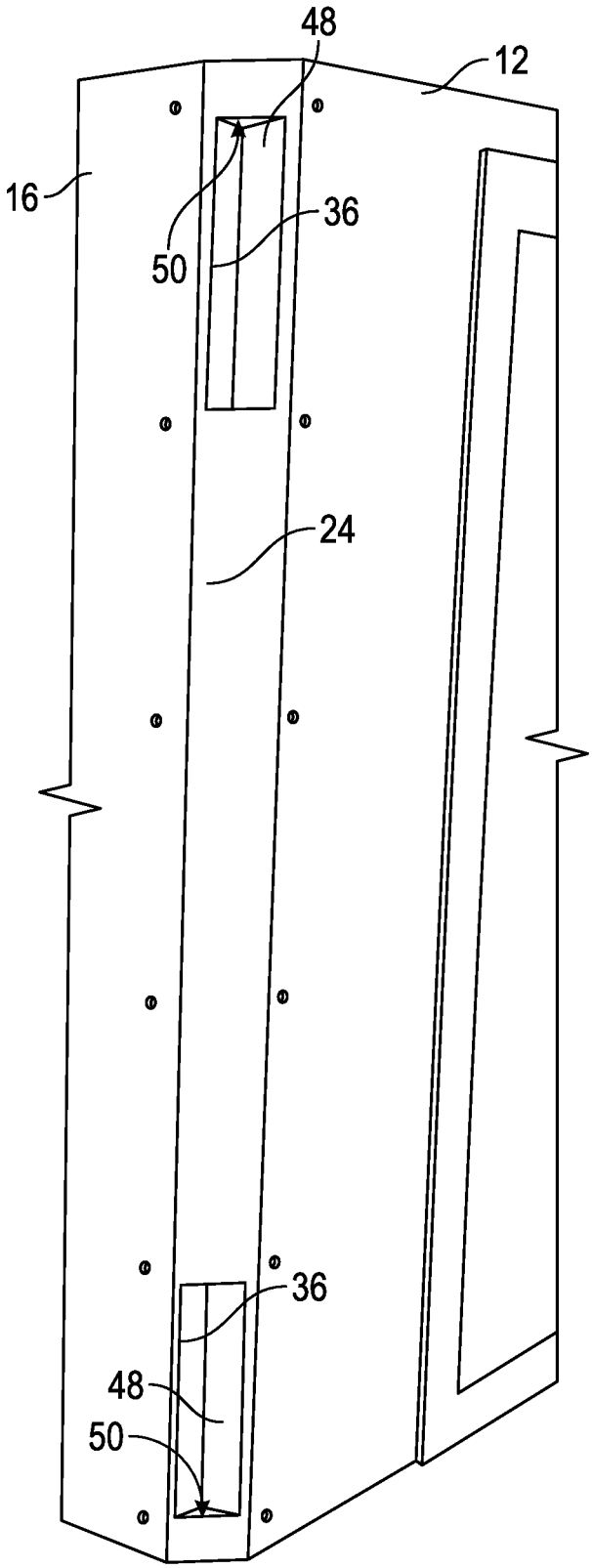
FIG. 4 is a perspective view of the shelter of FIG. 1A with the vent cover removed.

Referring to FIG. 4, each of the corners 24, 26, 28, and 30 has one or more openings or vents 36, which are depicted as two rectangularly shaped vents. However, the vents 36 may be of any suitable number and geometric shape, such as round, oval, triangular, or quadrilateral.

Figure 2:
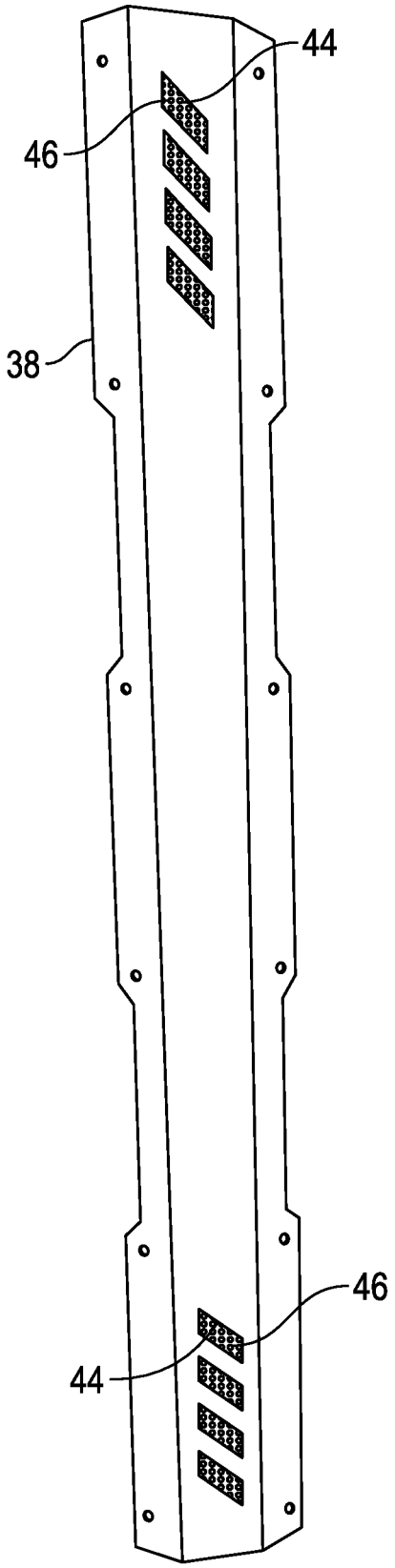
FIG. 2 is a perspective view of an exemplary embodiment of a vent cover.
Figure 3:
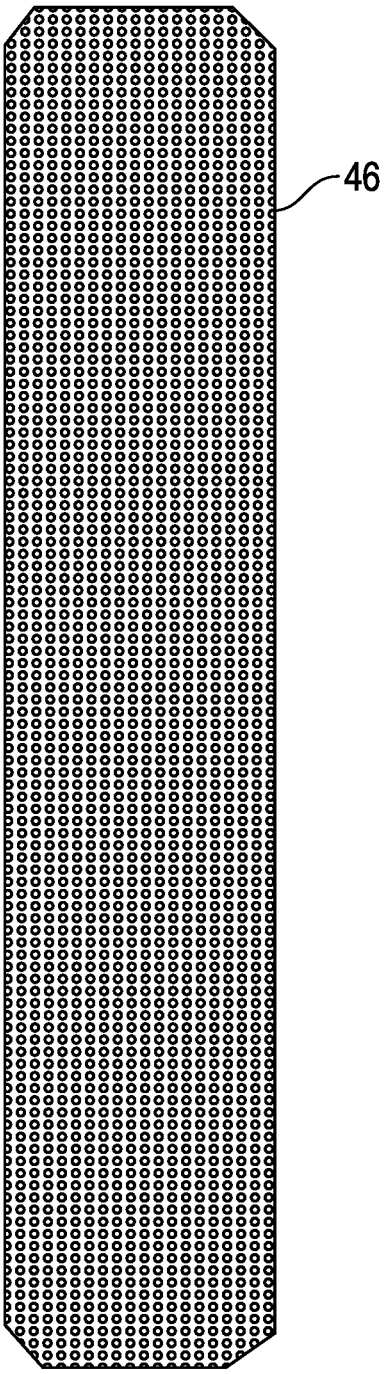
FIG. 3 is a perspective view of an exemplary embodiment of a screen.

As best shown in FIGS. 1A and 1B, the vents 36 are covered with an exterior vent cover 38 formed by a corner shaped member, which is secured to the walls by fasteners 40, such as bolts, which are removable. Hence, the exterior vent covers 38 may be removed and interchanged with a different vent cover. In one exemplary embodiment, the exterior vent cover 38 is configured to conform to the contour of the corner. The corner is beveled in shape in the illustrated example, so the exterior vent cover 39 is likewise beveled in shape. The exterior vent covers 38 prevent debris from flying into the interior of the security vault 10, but at least a portion of the exterior vent cover 38 is shaped to form a side opening 42 when secured to the main structure to allow for ventilation that is in communication with the vents 36. To further promote ventilation, the exterior vent covers 38 may include openings 44 aligned with the vents 36 when the exterior vent covers 38 are attached to the walls. These openings 44 may be covered with a perforated member 46, such as a perforated plate, a mesh, or a screen (FIGS. 2 and 3).

Figure 11B:
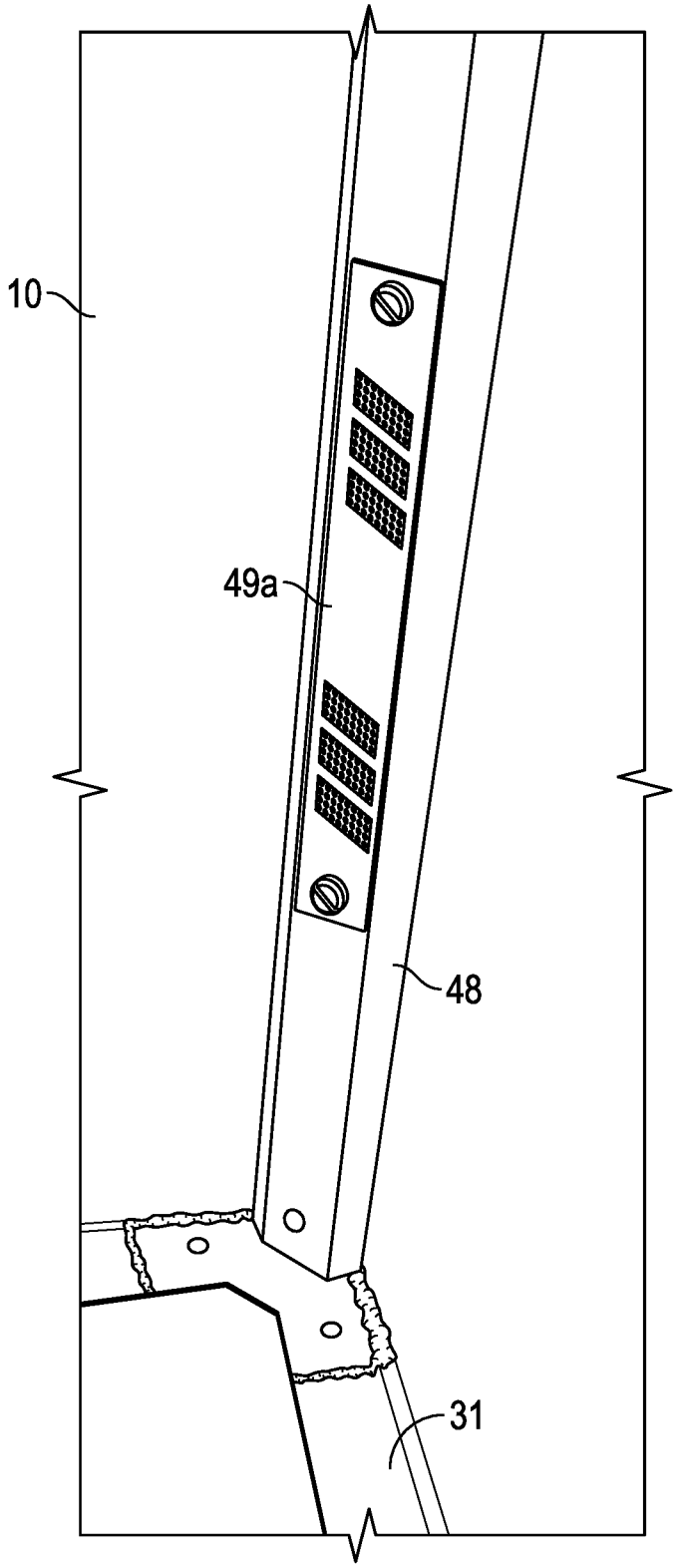
FIG. 11B is a perspective view of the interior vent cover of FIG. 11A

To prevent debris from flying into the interior of the security vault 10 via the perforated member 46, the security vault 10 may include a plurality of interior vent covers 48 (FIGS. 4 and 11). The interior vent covers 48 may be channel-shaped or V-shaped members positioned on the inside of the corners in alignment with the vents 36. The interior vent covers 48 may be secured to the interior of the corners in a suitable fashion, such as welding, so the interior vent covers 48 cooperate with the interior of the corners to form flow channels 50. The flow channels 50 may have an open top end, an open bottom end, or both (FIG. 4). As illustrated in FIG. 11A, the vent covers 48 may have vents 49, which may be covered with a second interior vent cover 49*a*, similar in construction to the exterior vent cover 38.

The exterior vent covers 38 and the perforated members 46, as well as the second interior vent covers 49*a*, can be customized at purchase or later to a customer's preference. These components, held on by bolts, screws, rivets, adhesives, or any other means, can be interchanged with ones of other shapes, colors, or textures to change the look of the security vaults. They can be layered and mixed and matched to create different visual effects. Some examples of such effects are (a) textures and colors in the immediate environment around the security vault 10, or (b) colors of some affiliation such as team, school, or sponsor. A light (not shown) can be secured on the interior of the vents 36 to achieve a visual effect, which is visible both outside the security vault 10 and from within. In addition to providing decoration, these lights can improve visibility inside and outside the security vault 10.

Figure 5:
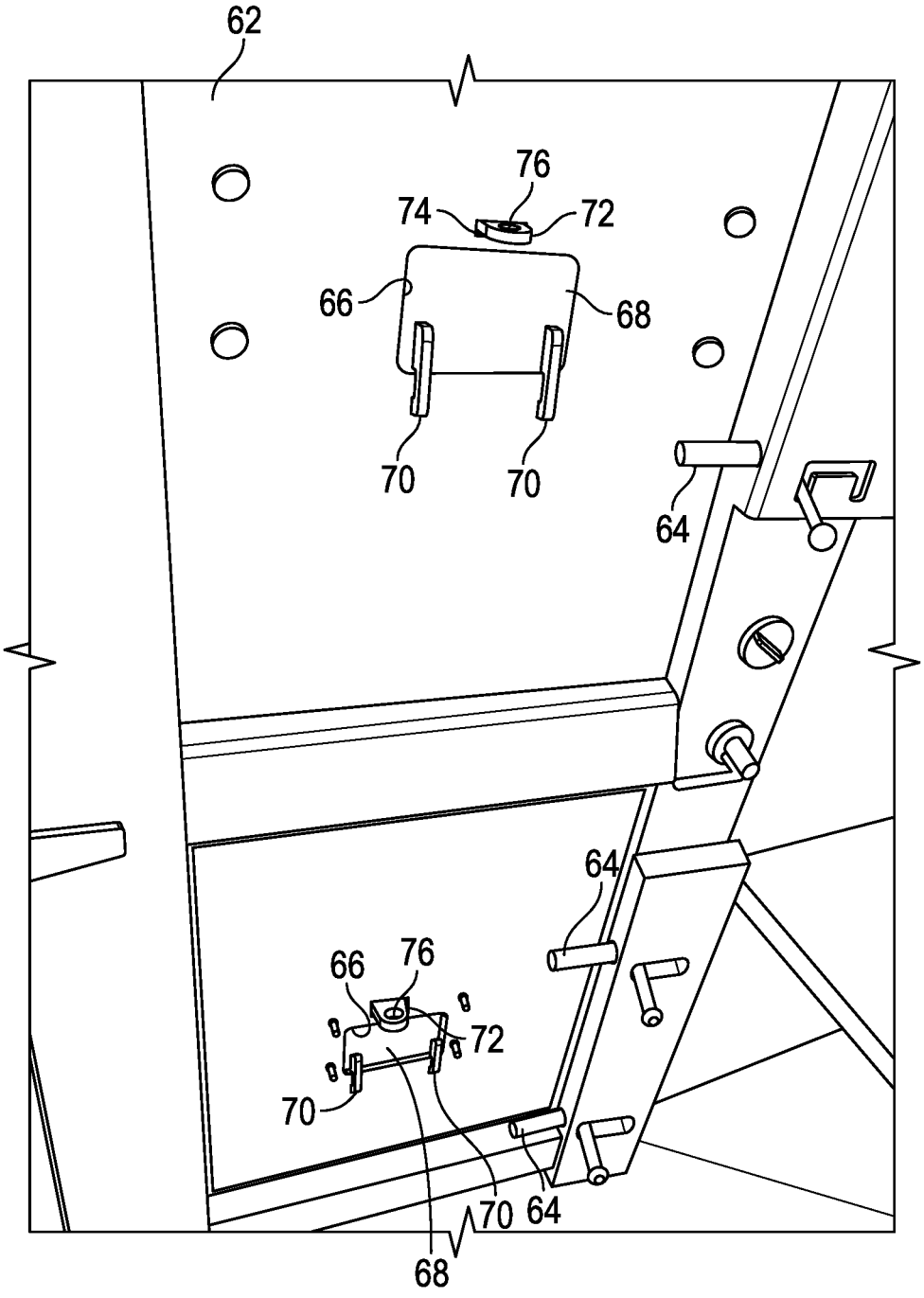
FIG. 5 is a perspective view of an interior side of an exemplary embodiment of a door of the shelter.
Figure 6:
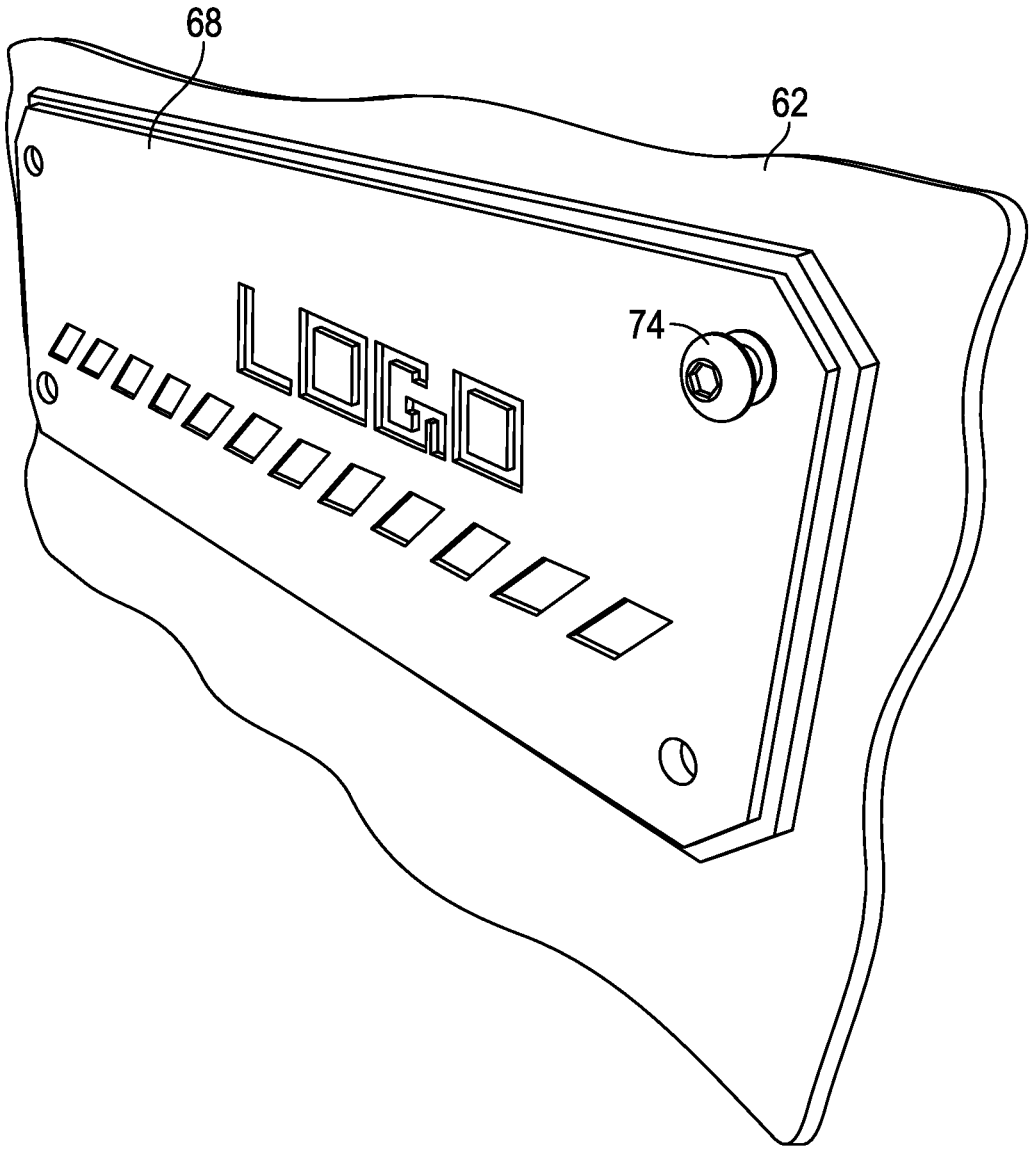
FIG. 6 is a perspective view of an exemplary embodiment of an upper cover plate shown connected to the door.

Referring now to FIGS. 1A and 5, the security vault 10 includes a door assembly 22 including a door frame 60 and a door 62 secured to the door frame 60 with a plurality of hinges (not shown). The hinges are arranged to permit inward opening of the door 62 to avoid having the door 62 blocked by debris piled against it during a storm. The opposing side of the door 62 is provided with one or more latches 64. The illustrated door 62 includes three latches 64 (FIG. 5), which are positioned on an inner side of the door 62.

As mentioned, the latches 64 of the door 62 can be difficult for a young child to unlatch should the child wonder into the security vault 10 and close the door 62. This results in the child being locked in the security vault 10. To alleviate this problem, the door 62 may be provided with one or more door passages 66 (FIGS. 5 and 7-10) adjacent the latches 64 to enable the latches 64 to be reached from the outside through the door passages 66.

Figure 7:
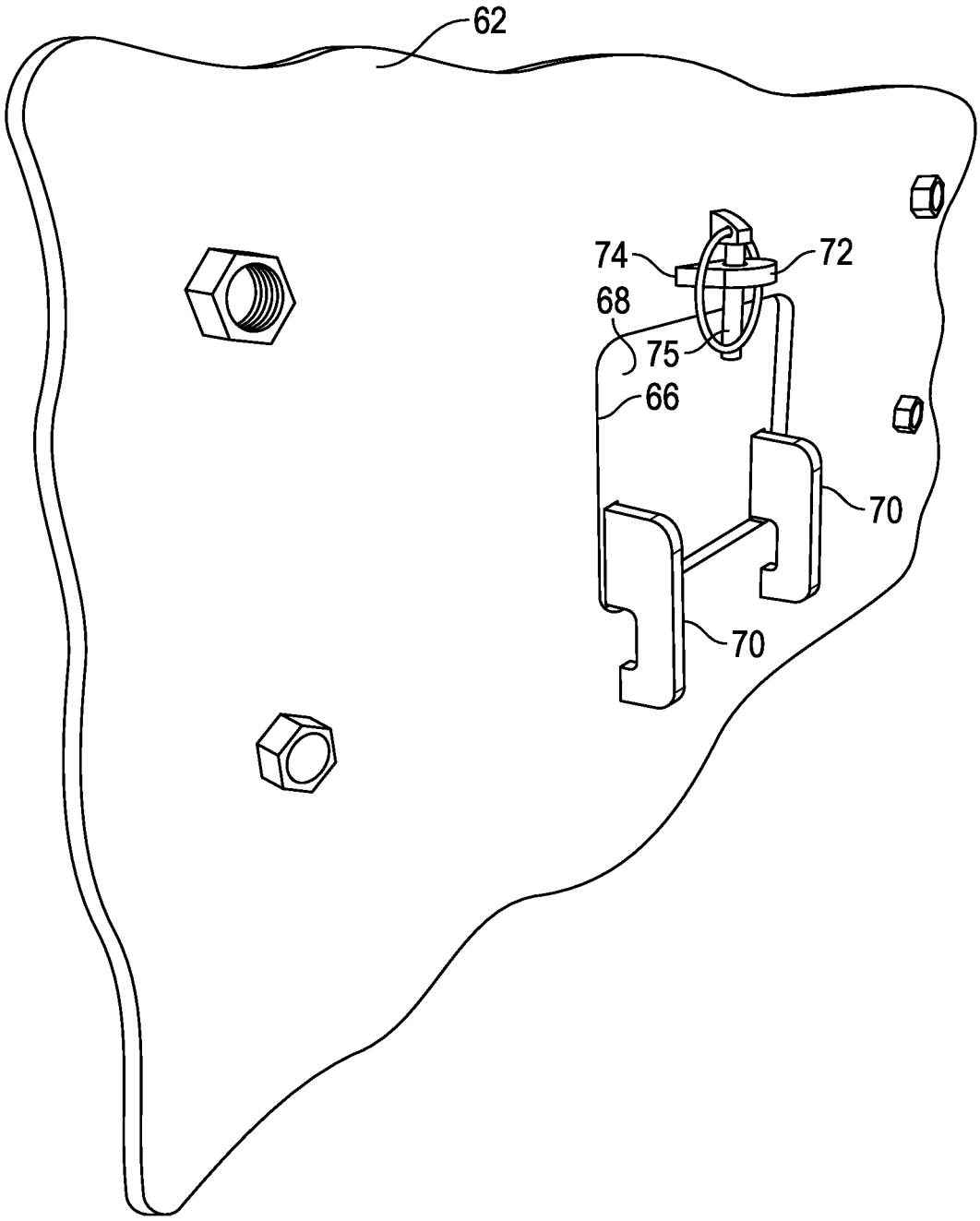
FIG. 7 is a perspective view of an interior side of the upper cover plate shown connected to the door and secured with a securement member.
Figure 8:
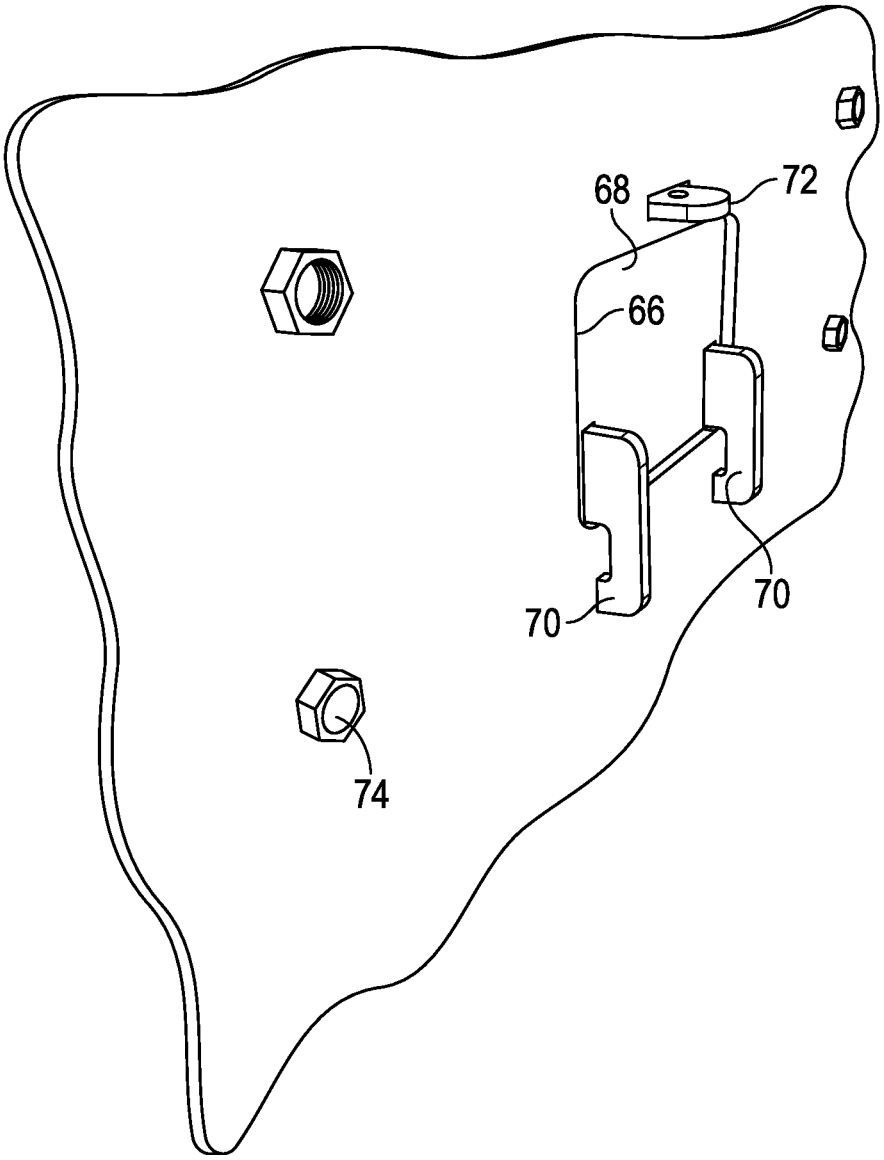
FIG. 8 is a perspective view of the interior side of the upper cover plate shown connected to the door with the securement member removed.
Figure 9:
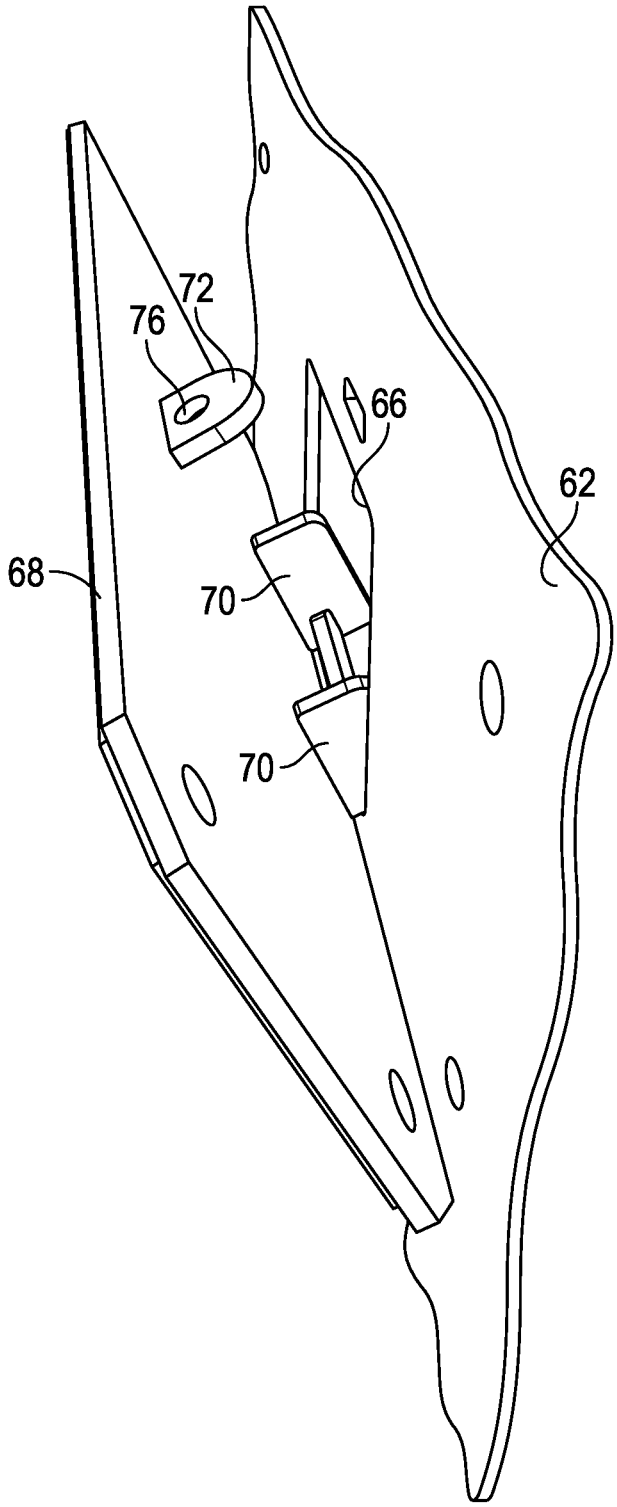
FIG. 9 is a perspective view of the door showing the cover plate partially removed.
Figure 10:
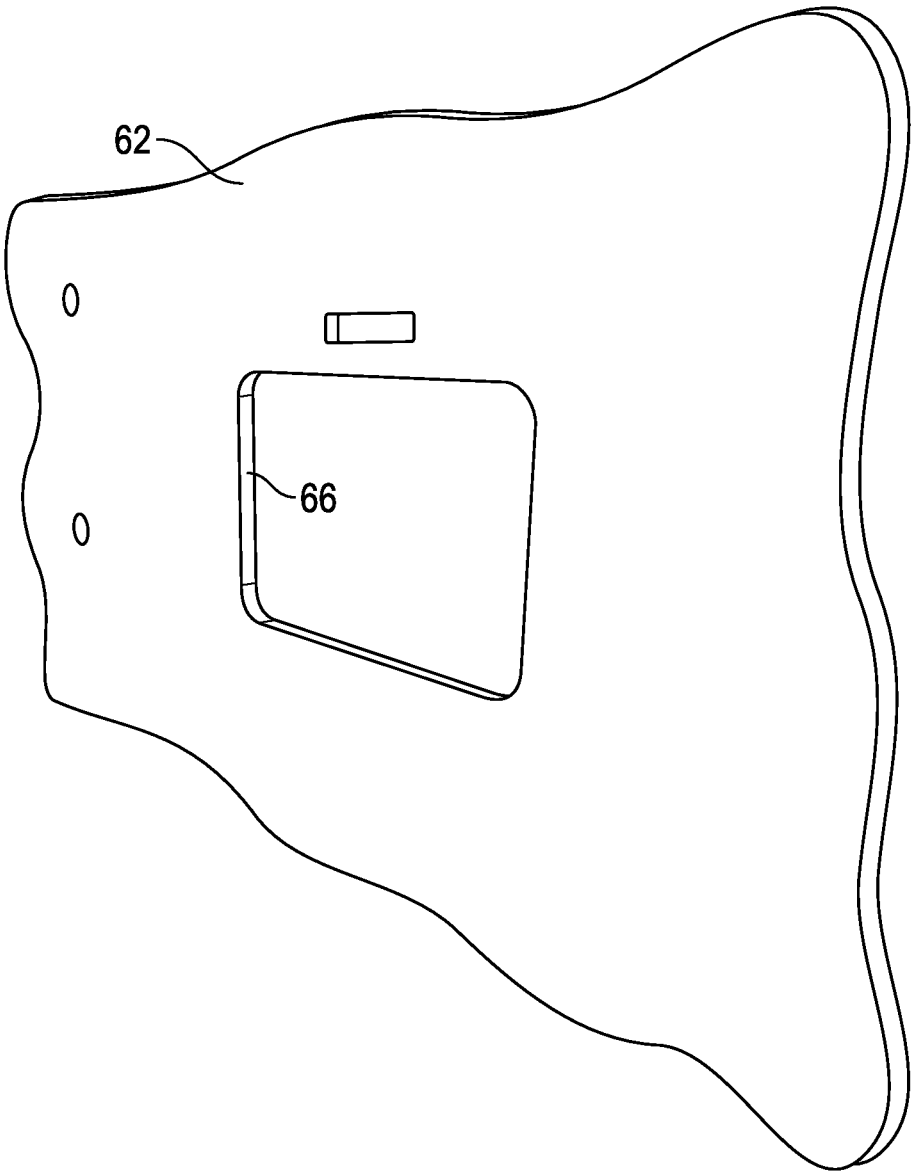
FIG. 10 is a perspective view of the door showing the cover plate removed.

Each of the door passages 66 is covered by a cover plate 68. An interior side of the cover plate 68 includes a pair of support members 70 and a tab 72. The support members 70 are configured to extend through the door passage 68 and engage an interior side of the door 62 (FIG. 7). The tab 72 is configured to extend through a slot 74 formed in the door 62 adjacent the door passage 66. The cover plate 68 is secured to the door 62 by fasteners 74, such as bolts or screws, positioned for removal from an exterior side of the security vault 10.

One problem presented with the ability to remove the cover plates 68 is lower security from thieves and/or intruders. To alleviate this problem, a securement member 75, such as a pin (FIG. 7), bolt, lever, or other securement member, which may be stored within the security vault 10, is inserted into a hole 76 formed in the tab 72 extending from the back of the cover plate 68. When inserted into the tab 72, the securement member 75 and the support members 70 cooperate to prevent the cover plate 68 from being removable from the door 62. When the securement member 75 is removed from the tab 72, the cover plate 68 may be removed from the door passage 66 by rotating the cover plate 68 to first remove the tab 72 from the slot 74 and then remove the support members 70 from the door passage 66. Any number of door passages 66 and cover plates 68 may correspond to the number of latches 64. In the security vault 10 illustrated, a lower door passage 66 can be used to access two latches 64.

Similar to the exterior vent covers 38 described above, the cover plates 68 can be customized at purchase or later to a customer's preference. These components, which are held on by bolts or screws, can be interchanged with other shapes, colors, or textures to change the look of the security vault. They can be layered and mixed and matched to create different visual effects. At least one of the cover plates 68 can be used to display a logo or the like.

Figure 12A:
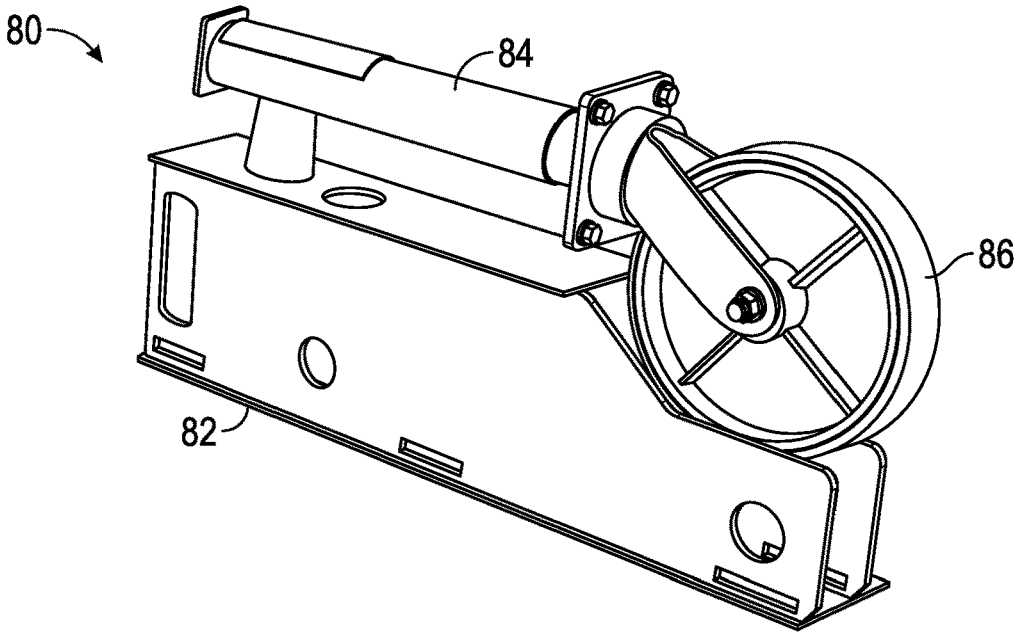
FIG. 12A is a perspective view of an exemplary embodiment of a jack assembly.
Figure 12B:
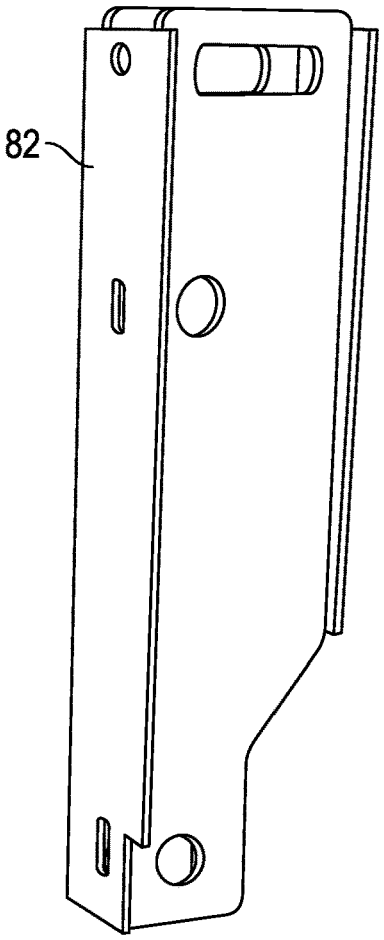
FIG. 12B is a perspective view of an exemplary embodiment of a mounting plate of the jack assembly of FIG. 12A.

Referring now to FIGS. 11-13, the security vault 10 may be manufactured at a site remote from the end user, such as a homeowner. The security vault 10 must be moved to a desired location when delivered to the end user. In one exemplary embodiment, the security vault 10 may include a plurality of wheel assemblies 80 to mobilize the security vault 10. The wheel assemblies 80 may include a mounting plate 82 and a jack assembly 84. The mounting plate 82 is configured to be secured to the security vault in a suitable manner. In one exemplary embodiment, the mounting plate 82 is configured to be secured to the interior surface of the security vault 10, such as the interior vent covers 48, so the mounting plates 82 are secured to the four corners of the security vault 10. The mounting plate 82 may be secured to the security vault 10 in any suitable way, such as bolts. It will be appreciated, however, that the mounting plate may be secured to other areas of the security vault 10, such as the interior or exterior side of the walls.

The jack assembly 84 is securable to the mounting plate 82. The jack assembly 84 has a caster 86. Through the use of the jack assemblies 84, the casters 86 can be lowered to raise the security vault 10 off the floor and allow it to be manually rolled. When the security vault 10 is transported to the desired location, the jack assemblies 84 are operated to raise the casters 86, lowering the security vault 10 to the floor. The wheel assemblies 80 may then be removed from the interior surface of the security vault 10. The jack assemblies 84 may be any type of jack assembly, such as mechanical, hydraulic, or pneumatic.

The security vault 10 can be anchored into place by passing bolts through the mounting flange and into a concrete slab, floor joists, or other suitable support structures.

The security vault 10 is well suited for use as a storm shelter. The security vault 10 may also be a panic room for a safe retreat in the event of a prowler or burglar entering the residence or business where the shelter is installed. The security vault 10 may also be a vault for valuable records or possessions and may be fitted with cabinets or shelves to provide organized storage. The security vault 10 may also be a walk-in gun safe for securing firearms and be equipped with barrel rests and standoff supports.

From the above description, it is clear that the inventive concept(s) disclosed herein is well adapted to carry out the objects and to attain the advantages mentioned herein as well as those inherent in the inventive concept disclosed herein. While exemplary embodiments of the inventive concept disclosed herein have been described for purposes of this disclosure, it will be understood that numerous changes may be made that will readily suggest themselves to those skilled in the art and which are accomplished without departing from the scope of the inventive concepts disclosed and claimed herein.

What is claimed is:

1. A security vault, comprising:

a housing defining a shelter cavity, the housing having a plurality of walls, a plurality of corners interconnecting the plurality of walls, and a roof connected to the plurality of walls and the plurality of corners, each of the plurality of corners has at least one vent opening formed therethrough;

a door assembly secured to at least one of the plurality of walls to permit ingress to and egress from the shelter cavity of the housing; and an exterior vent cover formed by a corner shaped member detachably secured to the walls so as to be interchangeable with a different vent cover, the exterior vent cover substantially conforming to a contour of the corner with at least a portion of the exterior vent cover cooperating with at least one of the walls to form a side opening in fluid communication with the vent opening to allow for ventilation to the shelter cavity, wherein the door assembly comprises:

a door frame connected to one of the walls;

a door hingedly connected to the door frame to permit opening of the door into the shelter cavity, the door having an exterior side, an interior side, at least one door passage extending through the door from the exterior side to the interior side, and at least one slot extending through the door from the exterior side to the interior side adjacent the door passage;

at least one latch positioned on an interior side of the door adjacent to the at least one door passage to enable the latch to be reached from the exterior side of the door through the door passage; and a cover plate covering the door passage and removably secured to the door with a plurality of fasteners, the cover plate having an interior side with a pair of support members and a tab extending therefrom, the support members extending through the door passage and engaging the interior side of the door, the tab extending through the slot, the fasteners positioned for removal from the exterior side of the door.

2. The security vault of claim 1, wherein each of the corners has a beveled shape.

3. The security vault of claim 1, wherein each of the exterior vent covers has an opening aligned with the vent openings, and wherein the openings are covered with a perforated member.

4. The security vault of claim 3, further comprising a plurality of interior vent covers positioned on an inside of the corners in alignment with the vent openings, wherein the interior vent covers cooperate with an interior of the corners to form flow channels, the flow channels having at least one open top end and one open bottom end.

5. The security vault of claim 4, wherein each of the interior vent covers is at least one of channel-shaped or V-shaped.

6. The security vault of claim 1, wherein the tab has a hole, and wherein the security vault further comprises a securement pin insertable into the hole to cooperate with the support members to prevent the cover plate from being removed from the door when the fasteners are removed from the cover plate, wherein with the securement pin removed from the hole, the cover plate is removable from the door passage by rotating the cover plate to first remove the tab from the slot and then to remove the support members from the door passage.

7. The security vault of claim 1, further comprising a plurality of wheel assemblies, the wheel assemblies comprising:

a mounting plate removably secured to an interior side of the housing; and a jack assembly attached to the mounting plate, the jack assembly having a caster and operable to lower the caster so as to raise the housing off of a floor and permit the housing to be manually rolled and to raise the casters so as to lower the housing to the floor.

8. A security vault, comprising:

a housing defining a shelter cavity, the housing having a plurality of walls, a plurality of corners interconnecting the plurality of walls, and a roof connected to the plurality of walls and the plurality of corners, each of the plurality of corners has at least one vent opening formed therethrough;

a door assembly secured to at least one of the plurality of walls to permit ingress to and egress from the shelter cavity of the housing; and an exterior vent cover formed by a corner shaped member detachably secured to the walls so as to be interchangeable with a different vent cover, the exterior vent cover substantially conforming to a contour of the corner and having at least one opening aligned with the vent openings, the at least one opening covered with a perforated member in fluid communication with the vent opening to allow for ventilation to the shelter cavity, wherein the door assembly comprises:

a door frame connected to one of the walls;

a door hingedly connected to the door frame to permit opening of the door into the shelter cavity, the door having an exterior side, an interior side, at least one door passage extending through the door from the exterior side to the interior side, and at least one slot extending through the door from the exterior side to the interior side adjacent the door passage;

at least one latch positioned on an interior side of the door adjacent to the at least one door passage to enable the latch to be reached from the exterior side of the door through the door passage; and a cover plate covering the door passage and removably secured to the door with a plurality of fasteners, the cover plate having an interior side with a pair of support members and a tab extending therefrom, the support members extending through the door passage and engaging the interior side of the door, the tab extending through the slot, the fasteners positioned for removal from the exterior side of the door.

9. The security vault of claim 8, wherein each of the corners has a beveled shape.

10. The security vault of claim 8, further comprising a plurality of interior vent covers positioned on an inside of the corners in alignment with the vent openings, wherein the interior vent covers cooperate with an interior of the corners to form flow channels, the flow channels having at least one open top end and one open bottom end.

11. The security vault of claim 10, wherein each of the interior vent covers is at least one of channel-shaped or V-shaped.

12. The security vault of claim 8, wherein the tab has a hole, and wherein the security vault further comprises a securement pin insertable into the hole to cooperate with the support members to prevent the cover plate from being removed from the door when the fasteners are removed from the cover plate, wherein with the securement pin removed from the hole, the cover plate is removable from the door passage by rotating the cover plate to first remove the tab from the slot and then to remove the support members from the door passage.

13. The security vault of claim 8, further comprising a plurality of wheel assemblies, the wheel assemblies comprising:

a mounting plate removably secured to an interior side of the housing; and a jack assembly attached to the mounting plate, the jack assembly having a caster and operable to lower the caster so as to raise the housing off of a floor and permit the housing to be manually rolled and to raise the casters so as to lower the housing to the floor.

14. A security vault, comprising:

a housing defining a shelter cavity, the housing having a plurality of walls, a plurality of corners interconnecting the plurality of walls, and a roof connected to the plurality of walls and the plurality of corners;

a door assembly secured in at least one of the plurality of walls to permit ingress to and egress from the shelter cavity of the housing, the door assembly comprising:

a door frame connected to one of the walls;

a door hingedly connected to the door frame to permit opening of the door into the shelter cavity, the door having an exterior side, an interior side, at least one door passage extending through the door from the exterior side to the interior side, and at least one slot extending through the door from the exterior side to the interior side adjacent the door passage;

at least one latch positioned on an interior side of the door adjacent to the at least one door passage to enable the latch to be reached from the exterior side of the door through the door passage; and a cover plate covering the door passage and removably secured to the door with a plurality of fasteners, the cover plate having an interior side with a pair of support members and a tab extending therefrom, the support members extending through the door passage and engaging the interior side of the door, the tab extending through the slot, the fasteners positioned for removal from the exterior side of the door.

15. The security vault of claim 14, wherein the tab has a hole, and wherein the security vault further comprises a securement pin insertable into the hole to cooperate with the support members to prevent the cover plate from being removed from the door when the fasteners are removed from the cover plate, wherein with the securement pin removed from the hole, the cover plate is removable from the door passage by rotating the cover plate to first remove the tab from the slot and then to remove the support members from the door passage.

16. The security vault of claim 14, further comprising a plurality of wheel assemblies, the wheel assemblies comprising:

a mounting plate secured to an interior side of the housing; and a jack assembly secured to the mounting plate, the jack assembly having a caster and operable to lower the caster so as to raise the housing off of a floor and permit the housing to be manually rolled and to raise the casters so as to lower the housing to the floor.

* * * * *